US005346423A

United States Patent [19]

Caveza et al.

[11] Patent Number: 5,346,423

[45] Date of Patent: Sep. 13, 1994

[54] TOY FOR MAKING SIMULATED FRENCH FRIES

[75] Inventors: Martin J. Caveza, Redondo Beach; Caleb S. Chung, Van Nuys; John N. Handy, Long Beach, all of Calif.

[73] Assignee: Mattel, Inc., El Segundo, Calif.

[21] Appl. No.: 12,062

[22] Filed: Feb. 1, 1993

[51] Int. Cl.[5] ..... A63H 33/30

[52] U.S. Cl. ..... 446/479; 426/104

[58] Field of Search ..... 446/479, 481, 246, 475, 446/491, 144; 434/219, 127; 426/104, 250

[56] References Cited

U.S. PATENT DOCUMENTS

| | | | |
|---|---|---|---|
| D. 183,650 | 10/1958 | Gaston . | |
| 385,234 | 6/1888 | Bon . | |
| 2,084,921 | 6/1937 | Skliris . | |
| 2,499,309 | 2/1950 | Harris . | |
| 2,586,823 | 2/1952 | Huhn . | |
| 3,120,717 | 2/1964 | Glass et al. | 446/481 X |
| 3,478,932 | 11/1969 | Phillips | 446/475 X |
| 3,612,129 | 10/1971 | Scarborough . | |
| 3,808,730 | 5/1974 | Cooper et al. | 446/481 |
| 3,907,215 | 9/1975 | Mantelet . | |
| 4,322,909 | 4/1982 | Holahan et al. | 446/479 |
| 4,764,147 | 8/1988 | Baker et al. | 446/397 |
| 4,869,435 | 9/1989 | Pistorius et al. . | |
| 4,913,017 | 4/1990 | Akrenius | 83/122 X |
| 4,998,348 | 3/1991 | Foate . | |
| 5,095,791 | 3/1992 | Jongerius . | |

*Primary Examiner*—Mickey Yu
*Attorney, Agent, or Firm*—Roy A. Ekstrand

[57] ABSTRACT

A toy for making simulated french fried potatoes includes a base supporting a generally rectangular housing within which a pair of cutter rollers are rotatably supported at the upper end thereof. A crank arm and gear coupling drive mechanism is operatively coupled to the cutter assembly to rotate the cutter rollers as the crank is turned. An upwardly extending cover member positioned above the cutter assembly includes a feed slot and guide passage which directs a bread slice deposited within the feed slot to the interface of the cutting rollers. As the crank is turned the bread slice is drawn through the cutter rollers and sliced into a plurality of elongated segments having an appearance similar to french fried potatoes. The bread segments are then collected within a collecting receptacle and a cooked appearance is imparted thereto by sprinkling coloring and flavoring agents such as cinnamon and sugar upon the bread segments.

5 Claims, 2 Drawing Sheets

TOY FOR MAKING SIMULATED FRENCH FRIES

FIELD OF THE INVENTION

This invention relates generally to food processors and particularly to children's toys replicating food processors.

BACKGROUND OF THE INVENTION

A variety of fast food items have become extremely popular with consumers through the years. Perhaps one of the most pervasive and popular fast food items is the food item generally known as "french fried potatoes" or more simply "french fries". French fries are provided in a variety of shapes and sizes in accordance with consumers preferences. However, all generally provide a potato usually cut into long thin segments which is deep fried to a golden brown color and salted and served. Children's toys often are fabricated to mimic or imitate food preparation activities. Thus, a wide variety of simulated food processors and cooking apparatus have been provided by practitioners in the art in attempting to meet the demand for such products and play activities by the consumer. For example, U.S. Pat. Des. 183,650 issued to Gaston sets forth a CHILD'S TOY having a horizontal base and vertically extending support member which in turn supports a simulated food hopper having an elongated auger extending through the bottom portion thereof. The auger is coupled to a hand crank. The child user turns the hand crank to provide visual and auditory responses of the simulated food processor.

U.S. Pat. No. 4,764,147 issued to Baker, et al. sets forth a TOY FRYING PAN for simulating actual frying of bacon or similar foods. The frying pan includes a noise maker comprising a roughened surfaced formed by outwardly extending filaments or the like on a movable member. The movable member rubs against fixed flexible fins supported within the simulated frying pan to produce the frying and popping sound of cooking food.

U.S. Pat. No. 4,322,909 issued to Holahan, et al. sets forth a TOY FOOD PROCESSOR having a base member supporting a simulated food processor bowl within which a rotatable simulated slicing cutter is supported. A hand crank drive mechanism is operatively coupled to the rotatable simulated cutter and provides rotation thereof within the food processor bowl. A plurality of simulated food articles formed of stacked arrays of simulated food slices are received within the food processor bowl and separated from the remainder of the food article slices as the simulated cutter is rotated to provide the appearance of food slicing.

U.S. Pat. No. 3,808,730 issued to Cooper, et al. sets forth a TOY OVEN having a simulated oven with movable trays supported therein. Food articles in a malleable state are positioned within the simulated oven and are altered in appearance by compressible telescopic mold members which extend downwardly into the oven cavity and alter the appearance of the food articles to imitate the cooking process.

U.S. Pat. No. 3,120,717 issued to Glass, et al. set forth a TOY COOKING UTENSIL WITH SOUNDING MEANS having a simulated frying pan defining a simulated cooking surface. A noise producing apparatus is operable within the simulated frying pan to provide sound effects which replicate the sound of frying food articles.

In addition to toy articles, practitioners in the art have provided other types of food processors. For example, U.S. Pat. No. 5,095,791 issued to Jongerius sets forth a BREAD SLICING MACHINE having a frame receiving a to-be-sliced loaf of bread. The frame supports first and second drums rotatably coupled to the frame and aligned in a vertical plane. An endless slicing band having cutting edges is passed around the first and second drums to form a figure eight and provide slicing of the loaf of bread as it is passed therethrough.

U.S. Pat. No. 4,998,348 issued to Foate sets forth a TODDLER MEAL PROCESSOR comprising a cutting implement for subdividing sandwiches into small child size pieces. The cutting implement includes a circular frame having a plurality of parallel cutting blades supported therein. U.S. Pat. No. 4,913,017 issued to Akrenius sets forth a MEAT CUTTING DEVICE having a feeding chute inclined toward a blade assembly. The blade assembly includes a plurality of disk-like cutting blades for cutting the food article as it passes through the cutting blades under the influence of gravity and blade rotation.

U.S. Pat. No. 4,869,435 issued to Pistorius, et al. sets forth a POCKET PAPER SHREDDER having a housing defining a paper entrance slot and a pair of shredding rollers together with drive means operable thereon. One of the shredding rollers includes an array of thin circular cutting knives axially spaced on the roller.

U.S. Pat. No. 3,907,215 issued to Mantelet sets forth a MANUALLY OPERATED FOOD CHOPPER having a horizontal rotatable shaft supporting a plurality of chopper blades in an axially spaced arrangement. A handle is coupled to the shaft to provide rotation thereof. A cradle surrounds the chopper blades and is supported within an upwardly opening hopper.

U.S. Pat. No. 3,612,129 issued to Scarborough sets forth a BARBECUED MEAT CUTTING MACHINE for slicing and chipping barbecued meat includes a framework supporting a plurality of spaced vertical rotating circular blades on a horizontal shaft. A second rotating shaft supports a second plurality of sharp blades which rotate between the circular blades to cut the slices into chips.

U.S. Pat. No. 2,586,823 issued to Huhn sets forth a HAND DIE having a generally rectangular framework supporting an upwardly extending handle and a plurality of cutting blades. The hand die is similar to a cookie cutter or the like and produces different shaped articles by forcing the blades downwardly against the food item.

U.S. Pat. No. 2,499,309 issued to Harris sets forth a PASTY CUTTER having a cup-shaped housing defining a cutting edge and supporting an upwardly extending handle. The pastry cutter is operated by forcing it down upon the food article to cut the food article to a shape corresponding to the outer edge of the cutter.

U.S. Pat. No. 2,084,921 issued to Skliris sets forth a SLICING MACHINE having a frame supporting a pair of rotating shafts one of which defines thin circular cutting blades while the other defines a roller having circular grooves therein spaced in correspondence to the circular blades of the other roller. A crank mechanism is provided which causes the rollers to turn in opposite directions and cut the food articles.

U.S. Pat. No. 385,234 issued to Bon sets forth a MACHINE FOR CUTTING SUGAR CANE having an elongated frame supporting a cane receiving hopper and a pair of oppositely rotating horizontal shafts. A plurality of cutting blades are supported on each shaft and operate to cut the sugar cane received within the hopper.

While the foregoing described prior art devices have enjoyed some measures of success, there remains a continuing need in the art for evermore interesting children's toys which simulate the preparation of food articles.

SUMMARY OF THE INVENTION

Accordingly, it is a general object of the present invention to provide an improved food processing simulator toy article. It is a more particular object of the present invention to provide an improved toy for making simulated french fries or the like.

In accordance with the present invention, there is provided for use in making simulated french fried potatoes, a toy comprises: a housing defining a feed passage for receiving a bread slice portion; a crank rotatably supported upon the housing; cutting means operatively coupled to the crank and positioned to receive the bread slice portion, the cutting means cutting the bread slice portion into a plurality of elongated segments; and means for applying a coloring material to the elongated segments to impart a browned cooked appearance thereto replicating french fried potatoes.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
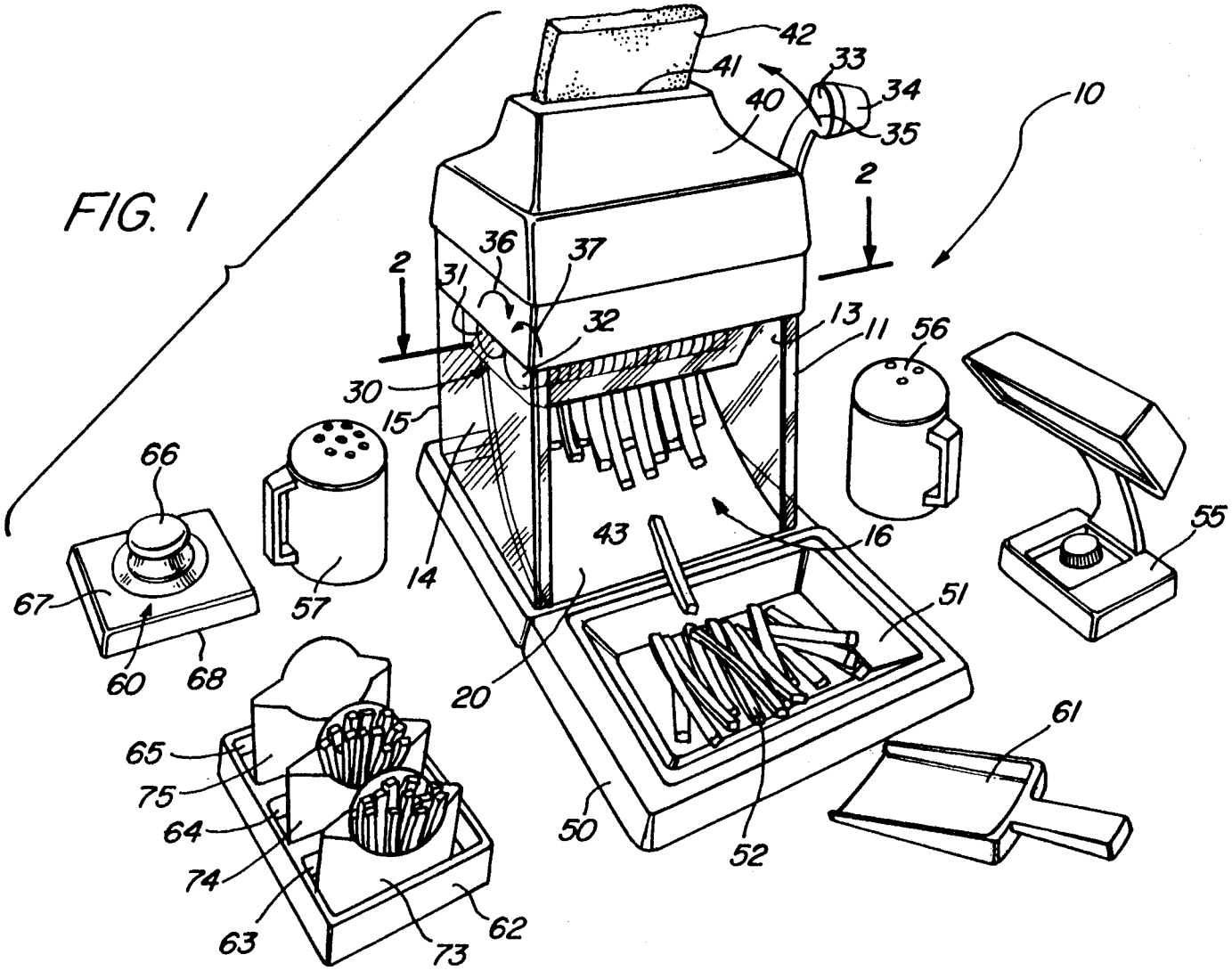
FIG. 1 sets forth a perspective view of a toy for making simulated french fries constructed in accordance with the present invention.

FIG. 1 sets forth a perspective view of a toy for making simulated french fries constructed in accordance with the present invention and generally referenced by numeral 10. Toy 10 includes a generally rectangular housing 11 supported by a rectangular base 12. Housing 11 includes vertical sides 13 and 14 and a back surface 15. Front portion 16 of housing 11 remains open and a curved upwardly inclined planar chute 20 extends upwardly within the interior of housing 11.

A cutter assembly 30 is supported in the upper portion of housing 11 and includes a pair of generally parallel cutter rollers 31 and 32. A rotatable crank 33 is rotatably secured to cutter assembly 30 by means set forth below in greater detail. Crank 33 supports a knob 34 at the outwardly extending end thereof. A cover 40 is received upon cutter assembly 30 and defines a downwardly extending rectangular feed slot 41.

Toy 10 further includes a cutting tray 50 defining a receptacle 51 therein. A warming lamp 55 and scoop 61 together with a pair of particulate material shakers 55 and 56 are included within toy 10. Additionally, a crust cutter 60 includes a generally rectangular die housing 67 defining a rectangular cutting edge 68. Cutter 60 further includes an upwardly extending handle 66 supported by die housing 67. A holding tray 62 defines a plurality of recesses 63, 64 and 65 which in turn receive a plurality of french fry type package cartons 73, 74 and 75.

In operation, the creation of simulated french fries begins with a bread slice from which the crust portions have been removed by crust cutter 60. Crust cutter 60 defines a cutting edge 68 smaller than the anticipated crust portion of a conventional bread slice. Thus, in a similar operation to that employed by a "cookie cutter" the crust portion is removed from a conventional bread slice by forcing crust cutter 60 downwardly upon the bread slice to force cutting edge 68 entirely through the bread slice and produce a rectangularly cut crustless bread slice such as bread slice 42. Bread slice 42 is then fed downwardly into cover 48 of toy 10 through feed slot 41. Concurrently, the user grasps knob 34 and turns crank 33 in the direction indicated by arrow 35. The turning of crank 33 operates by means set forth below in greater detail within cutter assembly 30 to rotate cutter rollers 31 and 32 in the directions indicated by arrows 36 and 37 to force bread slice 42 between cutter rollers 31 and 32 and by means set forth below in greater detail slice bread slice 42 into a plurality of elongated bread segments 43. Bread segments 43 then fall downwardly away from cutter assembly 30 under the influence of gravity as crank 33 continues to be turned. Once bread segments 43 are completely free of cutter assembly 30, they are guided downwardly and forwardly by chute 20 to be deposited within receptacle 51 of collecting tray 50. As successive bread slices are removed from their crust by crust cutter 60 and sliced into elongated bread segments by feeding them through slot 41 and turning crank 33 as described above, a quantity of bread segments 52 is collected within receptacle 52.

Once a desired quantity of bread segments 52 are collected within receptacle 51, the user then employs shakers 56 and 57 to impart the desired appearance and flavor characteristic to the bread segments. One of the most advantageous combinations of materials found for shakers 56 and 57 is that provided by a combination of cinnamon and sugar. Sugar adds a pleasant flavor to the bread segments while the deposited cinnamon collected upon the bread segment surfaces gives the bread segments a cooked or browned appearance adding a more realistic touch to the simulated french fries. During this process, warming lamp 55 may be used to maintain a steady heat upon bread segments 52.

Once the desired appearance and flavor have been achieved for bread segments 52 within receptacle 51, they may be removed and collected by scoop 61 for deposit within conventional french fry cartons such as carton 75 and thereafter placed within an available recess within holding tray 62. The use of scoop 61, cartons 73 through 74 and holding tray 62 is employed to mimic the popular french fry processing found in many fast food restaurants.

It should be noted that the present invention toy provides simulated french fries which may be eaten by the child user which are provided without the need for hazardous cooking operations or the like. The use of conventional sliced bread in providing the simulated french fries of the present invention toy makes the play pattern extremely convenient and easy to supply. As a result, the need for special product mixes or ingredients found in other simulated food processing systems is avoided.

Figure 2:
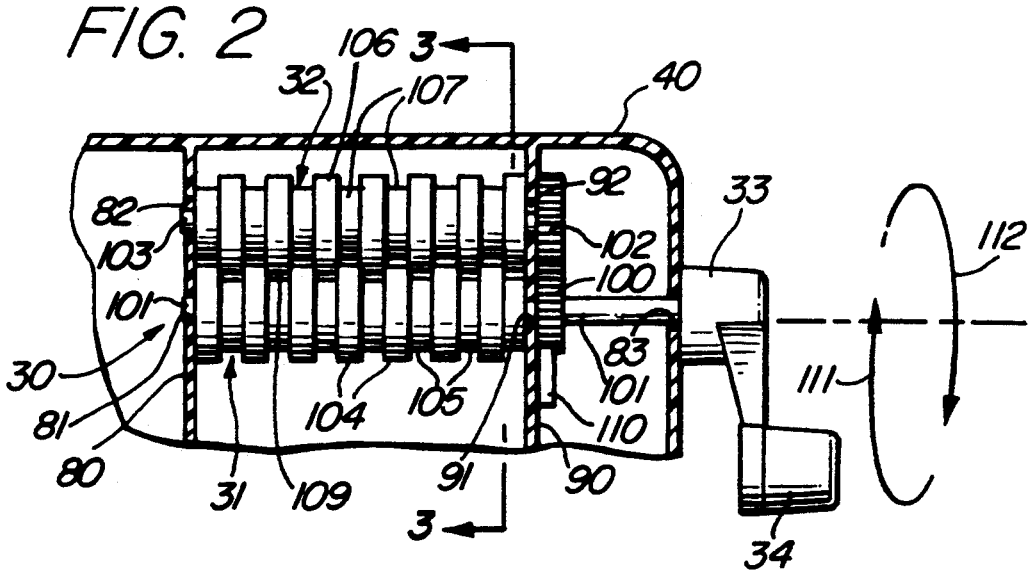
FIG. 2 sets forth a partial section view of the present invention toy taken along section lines 2—2 in FIG. 1.

FIG. 2 sets forth a section view of a portion of toy 10 taken along section lines 2—2 in FIG. 1. Cover 40 defines an interior cavity 44 within which a cutter housing 38 supports a cutter assembly 30. Cutter housing 38 includes a pair of spaced apart support ribs 80 and 90. Support rib 80 defines an aperture 81 and an elongated angularly positioned slot 82. Support rib 90 defines an aperture 91 and an elongated angularly disposed slot 92. Cover 40 defines an aperture 83 in alignment with apertures 81 and 91 of support ribs 80 and 90 respectively. An elongated shaft 101 extends through apertures 83, 91 and 81 and is rotatable therein. Shaft 101 supports a crank 33 at the outer end thereof external to cover 40. Shaft 101 further supports a gear 100 and a cutter roller 31. Cutter roller 31 includes a plurality of cylindrical cutting members 104 and interspaced clearance grooves 105 arranged in an alternating series. In its preferred form, the diameters of cutting members 104 and depths of clearance grooves 105 are substantially equal. In addition, also in its preferred form, the width or span of cutting members 104 and clearance grooves 105 is approximately equal. Gear 100 is received upon and secured to shaft 101 as are cutter roller 31 and crank 33. Thus, rotation of crank 33 produces a corresponding rotation of gear 100 and cutter roller 31.

Cutter assembly 30 further includes an elongated shaft 103 rotatably supported within slots 82 and 92 of support ribs 80 and 90 respectively. Shaft 103 supports a cutter roller 32 having alternately spaced cutting members 106 and clearance grooves 107. Cutting members 106 of cutter roller 32 extend into clearance grooves 105 of cutter roller 31. Conversely, cutting members 104 of cutter roller 31 extend into clearance grooves 107. The spacing between cutter rollers 31 and 32 is variable due to the movement of shaft 103 within slots 82 and 92. However, this movement is limited and is intended to provide some adjustment capability for cutter assembly 30 to adapt to different thicknesses and firmness of bread slices. Importantly, however, a plurality of small spaces 109 are maintained between each cutting member of rollers 31 and 32 and their respective clearance grooves. In addition, gear 102 is preferably formed of equal size and dimension to gear 100 of shaft 101. Thus, gear 100 transmits rotational power to gear 102 as shaft 101 is rotated. It should be noted that because of the direct coupling of gears 100 and 102, cutter rollers 31 and 32 always rotate in opposite directions as crank 33 is turned. While in some applications the weight of cutting roller 32 may be sufficient to properly tension cutter roller 32 against cutter roller 31 to provide the desired bread cutting, it has been found advantageous to include one or more compression springs such as spring 108 shown in FIG. 3 operative upon shaft 103 to maintain an engaging force between cutter rollers 31 and 32. The spatial movement or spacing tolerance between cutter rollers 31 and 32 is limited by the size of slots 82 and 92. However, as a practical matter, the degree of movement by cutter roller 32 should not exceed the gear engagement range between gears 100 and 102. Thus, while the gear engagement between gears 100 and 102 may tolerate some separation variation, it should not exceed that required to maintain engagement because cutter roller 32 relies upon this engagement to receive rotational power from gear 100 as crank 33 is turned. In any event, cutter rollers 31 and 32 are operative as crank 33 is rotated in the directions indicated by arrows 111 and 112 to cause rotation of shaft 101, gears 100 and 102 and cutter rollers 31 and 32. As is better seen in FIG. 3 as cutter rollers 31 and 32 are rotated under the rotation of crank 33 in the direction of arrows 111 and 112, their rotation draws a bread slice such as bread slice 42 into the cutter assembly and forces it downwardly between the cutter rollers to produce the slicing action due to the tight clearance between each cutting member and its respective clearance groove.

Figure 3:
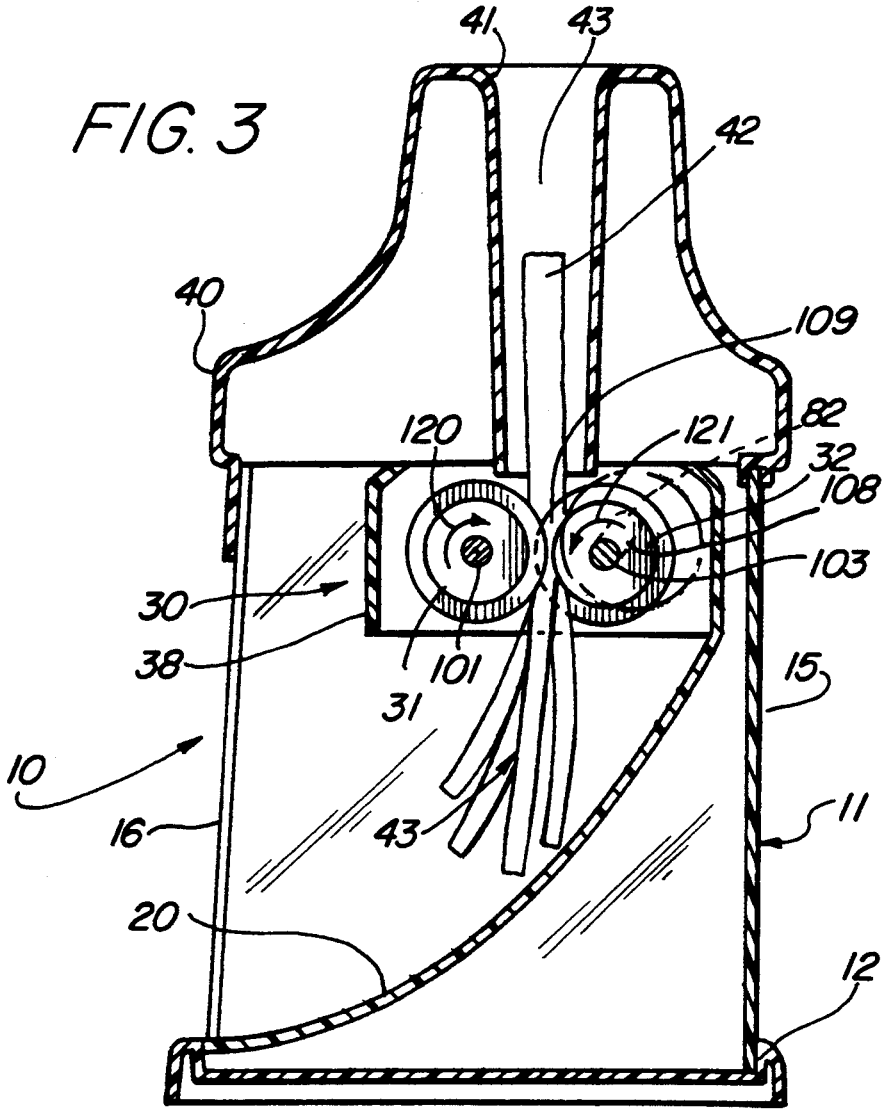
FIG. 3 sets forth a section view of the present invention toy taken along section lines 3—3 in FIG. 2.

It will be apparent to those skilled in the art that cutting rollers 31 and 32 will perform their cutting function solely as they are rotated in the respective directions which move the upper surfaces of each cutting roller toward the roller interface (arrows 120 and 121 in FIG. 3). Thus, it may be desirable in the preferred embodiment of the present invention to provide a conventional single direction ratchet mechanism such as single direction drive 110. Such mechanisms are well known in the art and operate upon a gear or similar member to restrict movement to one rotational direction. However, it may, in some applications be preferable to omit single direction ratchet 110 thereby permitting crank 33 to be rotated in both directions and assist in the removal of objects which may have become lodged between the rollers.

FIG. 3 sets forth a section view of the present invention toy taken along section lines 3—3 in FIG. 2. As described above, toy 10 includes a generally planar base 12 having upwardly extending back and side surfaces 15 and 14 respectively and defining an open front 16. A cover 40 is received upon housing 11 and defines an elongated feed slot 41 and a downwardly extending feed passage 43. A cutter assembly 30 includes a cutter housing 38 supported by cover 40 in accordance with conventional fabrication techniques and a pair of cutter rollers 31 and 32. Cutter rollers 31 and 32 are supported by rotational shafts 101 and 103 respectively. Cutter roller 32 is supported within a pair of elongated angularly disposed slots 82 and 92, the latter seen in FIG. 2. In its preferred form, a spring 108 is received within slot 82 and exerts a tensioning force against shaft 103 of cutter roller 32. A curved chute 20 extends downwardly beneath cutter assembly 30 and provides a sliding surface for bread segments severed by cutter assembly 30 to deliver the bread segments to opening 16 in the front portion of housing 11.

In operation, a bread slice 42 having been received within feed slot 41 in the manner shown in FIG. 1 is drawn downwardly through feed passage 43 by the gravitational force thereon to be received against cutter rollers 31 and 32. Thereafter, the user turns crank 33 in the direction indicated by arrows 111 and 112 in FIG. 2 to produce inward opposite direction rotation of cutter rollers 31 and 32 in the direction of arrows 120 and 121. This inward rotation of cutter rollers 31 and 32 grasps the bottom edge of bread slice 42 and draws it downwardly between the cutter rollers. As crank 33 continues to be rotated, cutter rollers 31 and 32 draw bread slice 42 through the spacing between the cutter rollers and sever bread slice 42 into a plurality of elongated bread segments 43. This process continues until bread slice 42 has passed completely through cutter rollers 31 and 32. Bread segments 43 then fall downwardly upon chute 20 and outwardly through open front 16 in the manner described and shown in FIG. 1. The user may then feed additional bread slices into slot 41 and feed passage 43 to continue the process and produce the desired number of bread segments 43. It should be noted that in its preferred form, cover 40 extends upwardly a sufficient distance to provide a length of feed passage 43 which is sufficient to preclude child users from reaching cutter rollers 31 and 32.

Once the desired number of bread segments 43 have been cut and accumulated (in receptacle 51 seen in FIG. 1), the above-described process of flavoring and altering the appearance of the bread segments may be carried forward such as applying a cinnamon and sugar coating for flavoring and to impart the appearance of cooking or browning to the bread segments. In addition, it will be recognized by those skilled in the art that the passage of bread slice 42 between cutter rollers 31 and 32 imparts a certain compressive effect to the resulting bread segments 43. It will be also apparent to those skilled in the art that this degree of compression is for any given thickness of bread slice 42 controllable by controlling the size of spaces 109 and the rolling surface characteristics and spacing between cutter rollers 31 and 32. Thus, additional realism and french fry appearance may be achieved by introducing this compressive character to bread segments 43 as well as providing surfaces upon the cutting members and clearance grooves of cutter rollers 31 and 32.

What has been shown is an interesting and amusing toy for young children which provides the creation of simulated french fries utilizing simple sliced bread and readily available ingredients such as sugar and cinnamon. The inventive toys shown permits the user to mimic the familiar fast food restaurant activities of producing french fried potatoes without exposure to the potentially harmful cooking apparatus otherwise associated with such french fries. The present invention is able to function without heating elements or the like thereby maximizing safety for the child user. The food product produced is extremely healthful and may aid the parent in improving the child's nutrition through the use of enriched bread or the like for creating the simulating french fries.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in making simulated french fried potatoes, a toy comprising:

a housing defining a feed passage for receiving a bread slice portion extending upwardly within said housing which is substantially greater in length than a child's finger length and a frontal opening and a curved downwardly inclined chute for guiding said bread segments outwardly through said frontal opening;

a crank rotatably supported upon said housing;

cutting means including a pair of rollers having interleaved cutting members and clearance grooves formed therein and a pair of equal diameter gears mutually meshed and each coupled to one of said rollers operatively coupled to said crank and positioned to receive said bread slice portion, said cutting means cutting said bread slide portion into a plurality of elongated segments;

means for receiving and retaining a supply of coloring material and for applying a coloring material to said elongated segments to impart a browned cooked appearance thereto replicating french fried potatoes including a shaker having an interior cavity and multiple aperture top; and a crust removing die having a rectangular cutting edge corresponding to the size of bread slice portion to be placed within said passage.

2. For use in making simulated french fried potatoes, a toy comprising:

cutting means for receiving a bread slice portion and cutting said bread slice portion into a plurality of elongated segments; and means for imparting a cooked appearance to said segments including a coloring agent.

3. A toy as set forth in claim 2 further including a bread crust removing die having a rectangular cutting edge.

4. Means for making simulated french fried potatoes, without cooking, comprising:

housing means having a slot defined therein for receiving a bread slice and cutting means for cutting said bread slice into a plurality of elongated substantially even cross-sectional sized segments;

actuation means, supported by said housing means, for operating said cutting means;

collecting means for collecting a quantity of said segments;

coloring means for applying a coloring material to portions of said segments to impart a cooked appearance thereto; and means for placing at least a portion of said quantity of said segments, once colored, into a french fry container.

5. The means of claim 4 further including means for removing the crust from said bread slice.

* * * * *